US008932677B2

(12) United States Patent
Marcus et al.

(10) Patent No.: US 8,932,677 B2
(45) Date of Patent: Jan. 13, 2015

(54) DIGITAL DROP PATTERNING AND DEPOSITION DEVICE

(75) Inventors: Michael A. Marcus, Honeoye Falls, NY (US); Hrishikesh V. Panchawagh, San Jose, CA (US)

(73) Assignee: Eastman Kodak Company, Rochester, NY (US)

( * ) Notice: Subject to any disclaimer, the term of this patent is extended or adjusted under 35 U.S.C. 154(b) by 333 days.

(21) Appl. No.: 13/492,209

(22) Filed: Jun. 8, 2012

(65) Prior Publication Data

US 2013/0330475 A1 Dec. 12, 2013

(51) Int. Cl.
*B41J 2/005* (2006.01)
*B41J 2/015* (2006.01)

(52) U.S. Cl.
USPC ..... 427/256; 427/287; 427/288; 118/409; 118/410; 118/411; 118/412; 347/73; 347/74; 347/75; 347/171

(58) Field of Classification Search
None
See application file for complete search history.

(56) References Cited

U.S. PATENT DOCUMENTS 2,681,294 A 6/1954 Beguin
2,761,791 A 9/1956 Russell
4,001,024 A 1/1977 Dittman et al.
4,313,980 A 2/1982 Willemsens
6,287,384 B2 9/2001 Oki et al.
6,517,181 B2 2/2003 Yamamoto
6,579,569 B2 6/2003 Bermel et al.
2005/0208223 A1 * 9/2005 Yonkoski et al. ..... 427/356
2010/0188466 A1 7/2010 Clarke
2010/0238232 A1 9/2010 Clarke et al.

OTHER PUBLICATIONS

Meyer, Robert F., et al., "Universal Dripping and Jetting in a Transverse Shear Flow", Physical Review Letters 102, 194501, May 15, 2009.

* cited by examiner

*Primary Examiner* — Michael Cleveland
*Assistant Examiner* — Lisha Jiang
(74) *Attorney, Agent, or Firm* — William R. Zimmerli

(57) ABSTRACT

Liquid dispensing includes providing a downwardly inclined slide surface and a carrier liquid dispensing channel that includes an outlet opening on the slide surface. A carrier liquid source is pressurized causing carrier liquid to flow continuously through the outlet opening of the carrier liquid dispensing channel and down the slide surface. A liquid dispenser array structure is provided and includes functional liquid dispensers located on a substrate that is common to the functional liquid dispensers. The functional liquid dispensers include a functional liquid supply channel, a functional liquid source that provides functional liquid, and a drop formation device associated with an interface of the functional liquid supply channel and the slide surface. The drop formation device is selectively actuated to form discrete functional liquid drops in the carrier liquid flowing down the slide surface. The functional liquid is immiscible in the carrier liquid.

4 Claims, 3 Drawing Sheets

DIGITAL DROP PATTERNING AND DEPOSITION DEVICE

CROSS REFERENCE TO RELATED APPLICATIONS

Reference is made to commonly-assigned, U.S. patent application Ser. No. 13/492,166 (now U.S. Pat. No. 8,659,631), entitled "DIGITAL DROP PATTERNING AND DEPOSITION DEVICE" and Ser. No. 13/492,194 (now U.S. Pat. 8,633,955), entitled "DIGITAL DROP PATTERNING AND DEPOSITION DEVICE", all filed concurrently herewith.

FIELD OF THE INVENTION

This invention relates generally to the field of digitally controlled liquid ejection systems, and in particular to liquid ejection systems that eject a first functional liquid phase in a second carrier liquid phase.

BACKGROUND OF THE INVENTION

There is an increasing demand for patterned deposition of materials on receivers, in traditional applications, for example, image and document printing, and developing manufacturing applications. These deposition techniques are, typically, broadly classified as non-contact printing systems and methods including, for example, ink jet printing, and contact printing systems and methods including, for example, screen printing, flexography, offset lithography, slot coating, or slide coating.

Ink jet printing has become recognized as a prominent contender in the digitally controlled, electronic printing arena because, e.g., of its non-impact, low-noise characteristics, its use of plain paper and its avoidance of toner transfer and fixing that is required in electrophotography based printing methods. Micro-Electro-Mechanical Systems (or MEMS) devices are becoming increasingly prevalent as low-cost, compact devices having a wide range of applications. As such, MEMS devices, for example, MEMS transducers, have been incorporated into both DOD and CIJ printing mechanisms to control ink drop formation. Ink jet printing mechanisms can be categorized by technology as either drop on demand ink jet (DOD) or continuous ink jet (CIJ).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop formation mechanism such that the liquid jet breaks up into drops of ink in a predictable manner. One continuous printing technology uses thermal stimulation of the liquid jet to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

There is an increasing need for patterned deposition of increasingly complex liquids using inkjet printing especially in applications for manufacturing of functional devices. Many of these complex liquids are loaded with fine particles and have much higher viscosities compared to typical inks used in inkjet. Thus, these liquids are difficult to eject to form drops. U.S. Patent Application Publications 2010/0238232 and 2010/0188466, both by Clarke et al., show a continuous ink jet system in which a second liquid in introduced by an injection mechanism into a first liquid. Droplets of second liquid are formed in first liquid and then ejected into the air in the form of encapsulated drops. While this is a good way to create an inkjet system that can eject droplets of, for example, high viscosity inks that are difficult to otherwise eject by encapsulating the hard to jet liquid in another liquid whose properties are better suited to continuous ink jet; there is a need to be able to selectively inject the second liquid into first liquid so that second liquid is ejected only in the locations it is needed.

Contact type printing systems and methods, for example, screen printing, flexography, offset lithography, slot coating, or slide coating, typically enable deposition of more complex liquids and give a better control on thickness of the deposited layers. These methods suffer from a limitation of no digital control in printed pattern because only fixed patterns can be printed. It is expensive to make changes to the patterns by changing plates or screens. Also, these methods do not allow change of pattern on the fly which can be accomplished using other deposition techniques including, for example, inkjet printing systems and methods.

In addition, it has long been known in the art to coat a uniform layer of a liquid by a contact transfer of a bead formed by liquid emerging from a slot die as shown in U.S. Pat. No. 2,681,294. This coating system and method allows deposition of uniform films having a range of thickness of complex materials. It is also possible to coat multiple layers of different liquids uniformly as shown in U.S. Pat. No. 2,761,791. U.S. Pat. No. 6,517,181 describes a method of coating a mixture of liquids using control mechanisms to control the relative flow of at least of the on liquids to vary the concentration of the mixture to form a pattern when coated on the receiver.

Heretofore, however, the coating industry lacked the ability to transfer coat multiple liquids, where at least one of the liquids can be controllably dispersed in a carrier liquid to form discrete drops and to transfer the liquid drops to a receiver to produce a patterned deposition of the liquid.

SUMMARY OF THE INVENTION

According to an aspect of the present invention, a method of dispensing liquid includes providing a downwardly inclined slide surface. A carrier liquid dispensing channel is provided and includes an outlet opening on the downwardly inclined slide surface. A source of carrier liquid is provided that is in fluid communication with the carrier liquid dispensing channel. The source of carrier liquid is pressurized to cause the carrier liquid to flow continuously through the carrier liquid dispensing channel, through the outlet opening of the carrier liquid dispensing channel and down the downwardly inclined slide surface. A liquid dispenser array structure is provided and includes a plurality of functional liquid dispensers located on a substrate that is common to the plurality of functional liquid dispensers. The plurality of functional liquid dispensers includes a functional liquid supply channel, a source of functional liquid, and a drop formation device associated with each of the plurality of functional liquid dispensers at an interface of the functional liquid supply channel and the downwardly inclined slide surface. A functional liquid is provided to the plurality of functional liquid dispensers through the functional liquid supply channel using the source of functional liquid. The drop formation device is selectively actuated to form sequences of one or more discrete drops of the functional liquid in the carrier liquid flowing down the downwardly inclined slide surface. The functional liquid is immiscible in the carrier liquid.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
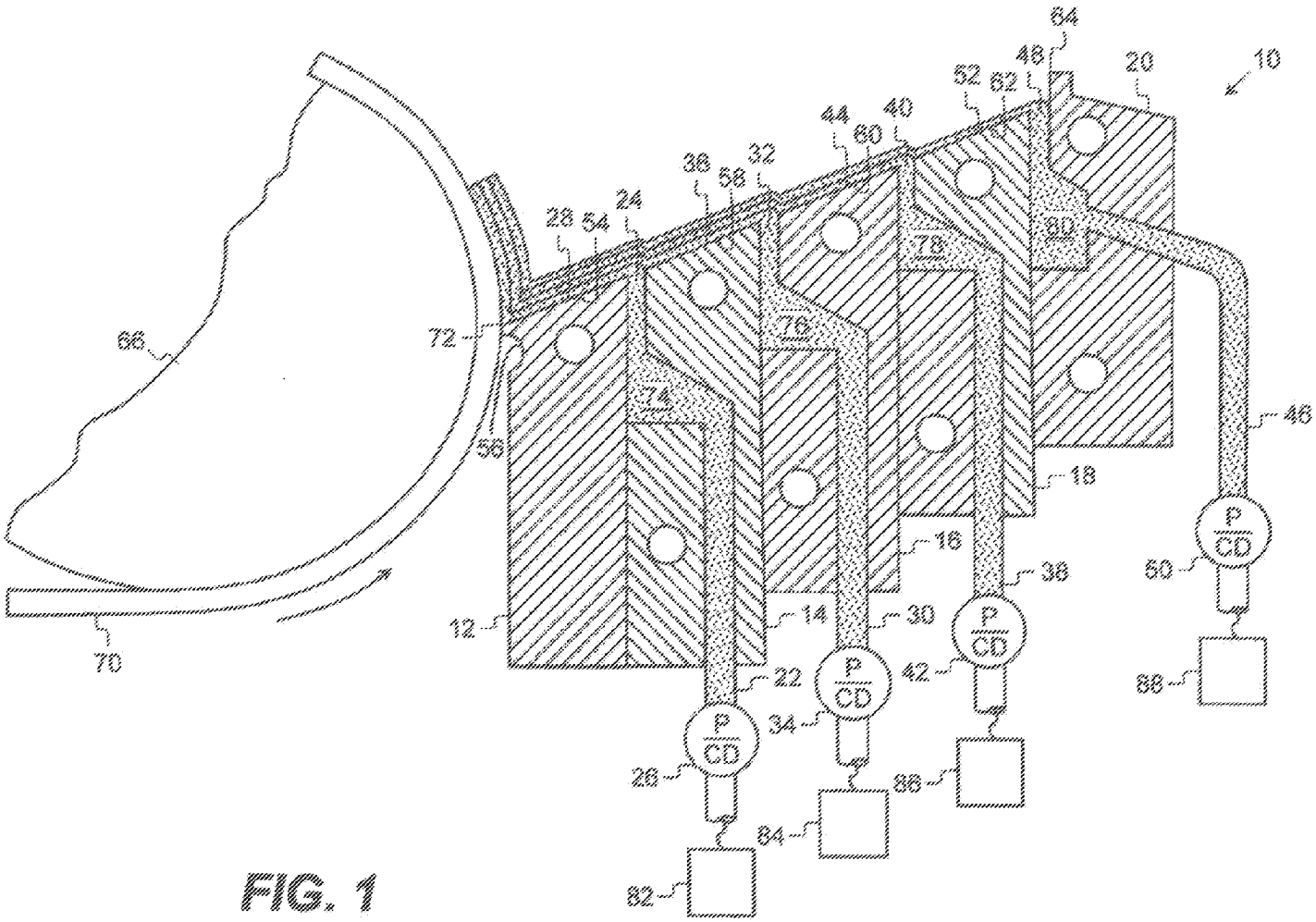
FIG. 1 is a schematic cross sectional side view of a liquid dispensing system, including a liquid dispenser array, made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide liquid ejection components that can be used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the liquid ejection system or the liquid ejection system components described below.

In addition to inkjet printing applications in which the liquid typically includes a colorant for printing an image, the present invention can also be advantageously used in ejecting other types of fluidic materials. Such materials include functional materials for fabricating devices (including conductors, resistors, insulators, magnetic materials, and the like), structural materials for forming three-dimensional structures, biological materials, and various chemicals. The present invention provides sufficient force to eject liquids having a higher viscosity than typical inkjet inks, and does not impart excessive heat into the liquids that could damage them or change their properties undesirably.

Advantageously, fluidic transfer by an example embodiment of the present invention that includes a liquid dispensing system made in accordance with the present invention permits a wide area to be coated simultaneously which results in a very high manufacturing productivity of liquid deposition products when compared to ink jet spraying methods. Another advantage is the ability to create liquid drop patterns in a flow of carrier liquid with example embodiments that include hybrid architectures such as a combination of the slot coating process with offset lithography ink transfer process to create and transfer functional liquid drop patterns to a receiver to permit "digital contact printing" of complex materials. Thus, the present invention combines advantages of ability to digitally control printed pattern in response to a variable input data such as in inkjet printing and high throughput, low cost, reliability, and ink-receiver latitude of contact printing methods such as slot coating and offset lithography.

The present invention provides a liquid dispenser, a liquid dispensing system, and a method of dispensing liquid. An example embodiment of the present invention is described below with reference to FIGS. 1-3. Advantageously, the present invention facilitates the coating of higher viscosity functional materials, also referred to herein as functional liquids, when compared to conventional slide or slot coating systems and methods.

Generally described, the liquid dispenser includes a downwardly inclined slide surface. A carrier liquid dispensing channel includes an outlet that exits onto the downwardly inclined slide surface. A carrier liquid source provides a carrier liquid that flows continuously through the carrier liquid dispensing channel, through the outlet of the carrier liquid dispensing channel, and down the downwardly inclined slide surface. A functional liquid supply channel includes an outlet that exits onto the downwardly inclined slide surface. A functional liquid source provides a functional liquid to the outlet of the functional liquid supply channel. A drop formation device, associated with an interface of the outlet of the functional liquid supply channel and the downwardly inclined slide surface, is selectively actuated to form a discrete drop of the functional liquid in the carrier liquid flowing down the downwardly inclined slide surface. The functional liquid is immiscible in the carrier liquid.

Generally described, the liquid dispensing system includes a downwardly inclined slide surface. A carrier liquid dispensing channel includes an outlet that exits onto the downwardly inclined slide surface. A carrier liquid flows continuously through the carrier liquid dispensing channel, the outlet of the carrier liquid dispensing channel, and down the slide surface. A liquid dispenser array structure includes functional liquid dispensers located on a substrate that is common to the functional liquid dispensers. The functional liquid dispensers include a functional liquid supply channel. A functional liquid source provides a functional liquid to the functional liquid dispensers through the functional liquid supply channel. A drop formation device, associated with an interface of the functional liquid supply channel and the downwardly inclined slide surface, is selectively actuated to form discrete functional liquid drops in the carrier liquid flowing down the slide surface. The functional liquid is immiscible in the carrier liquid.

Generally described, the method of dispensing liquid includes providing a downwardly inclined slide surface and a carrier liquid dispensing channel that includes an outlet opening on the slide surface. A carrier liquid source is pressurized causing carrier liquid to flow continuously through the outlet opening of the carrier liquid dispensing channel and down the slide surface. A liquid dispenser array structure is provided and includes functional liquid dispensers located on a substrate that is common to the functional liquid dispensers. The functional liquid dispensers include a functional liquid supply channel, a functional liquid source that provides functional liquid, and a drop formation device associated with an interface of the functional liquid supply channel and the slide surface. The drop formation device is selectively actuated to form discrete functional liquid drops in the carrier liquid flowing down the slide surface. The functional liquid is immiscible in the carrier liquid.

The present invention includes no cover. As such, the inclined slide surface of the present invention is exposed to the environment, for example, open to the atmosphere. During operation, when carrier liquid is continuously flowing down the inclined slide surface, the top surface of the carrier liquid is exposed to the environment, for example, open to the atmosphere, due to the lack of a cover. The present invention does not include walls between the liquid dispensers of the liquid dispenser array structure. Not including walls between the liquid dispensers does not create channels for the functional liquid drops to travel along. This helps to reduce what is commonly referred to as drop "weave" by helping to reduce shear forces that are created because the velocity of the liquid is typically slower along the walls of the channel when compared to the velocity in the middle of the channel. The lack of a cover helps to reduce what is commonly referred to as drop "weave" by helping to reduce shear forces that are created because the velocity of the liquid is typically slower along the cover of the channel when compared to the velocity in the middle of the channel.

In the present invention, not all liquid dispenser array structures have to provide discrete drops of functional material. For example, some arrays can provide only carrier liquid without providing functional material. In this configuration, the carrier liquid layers or a "stack" of carrier liquid layers can become part of the final product. Additionally, the drop formation device can be repetitively actuated to form continuous lines of functional material from the discrete drops of the functional liquid. The length of the line is determined by the time interval of repetitive actuation of the drop formation device.

Referring to FIG. 1, a schematic example embodiment of a liquid dispensing systems made in accordance with the present invention is shown. A multi-slot slide bead coating apparatus 10 is used to deliver and coat multiple coating compositions simultaneously as a stacked composite of layers. Coating hopper 10 is shown as having only four slots, but multiple slot hoppers 10 may have fewer than four slots and are also known to deliver a composite layer comprised of five or six (or even more) coating composition layers.

Coating hopper 10, shown in side elevational cross-section, includes a front section 12, a second section 14, a third section 16, a fourth section 18, and a back plate 20. There is an inlet 22 into second section 14 for supplying coating liquid from a liquid source or supply 82 to first metering slot 24 via a regulated pressure source 26, for example, a pump, to thereby form a lowermost layer or carrier layer 28. There is an inlet 30 into third section 16 for supplying coating liquid from a liquid source or supply 84 to second metering slot 32 via a regulated pressure source, for example, a pump, 34 to form layer 36. There is an inlet 38 into fourth section 18 for supplying coating liquid from a liquid source or supply 86 to third metering slot 40 via a regulated pressure source, for example, a pump, 42 to form layer 44. There is an inlet 46 into back plate 20 for supplying coating liquid from a liquid source or supply 88 to fourth metering slot 48 via a regulated pressure source, for example, a pump, 50 to form layer 52. Each slot 24, 32, 40, 48 includes a transverse distribution cavity. Front section 12 includes an inclined slide surface 54, and a coating lip 56. There is a second inclined slide surface 58 at the top of second section 14. There is a third inclined slide surface 60 at the top of third section 16. There is a fourth inclined slide surface 62 at the top of fourth section 18. Back plate 20 extends above inclined slide surface 62 to form a back land surface 64.

Residing adjacent the hopper 10 is a receiver conveyance mechanism. As shown in FIG. 1, the receiver conveyance mechanism includes a coating backing roller 66 about which a receiver web 70 is conveyed. Typically, the hopper 10 is movable from a non-coating position toward the coating backing roller 66 and into a coating position. In the liquid dispensing system of the present invention, receiver web 70 serves as either a substrate that is included in the final product or as a temporary receiver, for example, a belt, from which the final product is removed after application of the carrier liquid (s) and the functional material(s) or liquid(s). Alternatively, the surface of backing roller 66 facing coating hopper 10 can serve as a temporary receiver from which the product is removed after application of the carrier liquid(s) and the functional material(s) or liquid(s).

The lowermost or carrier layer 28 is metered through the first metering slot 24, moves down the first slide surface 54, and wets the moving web 70 at the point where the coating bead 72 contacts the web 70. The second liquid layer 36 which is metered through a second metering slot 32, moves down the second slide surface 58, and is accelerated by the carrier layer 28 down the first slide surface 54 to the coating bead 72. The second layer 36 may be of a distinct composition relative to the first layer 28 or of the same composition and can be miscible or immiscible with lowermost layer 28. As noted by layers 44, 52 in FIG. 1, additional upper layers may also be applied using the slide bead coating apparatus 10. These additional upper layers may be of a distinct composition relative to the first layer 28 or second layer 36 or of the same composition. The additional upper layers 44, 52 can be miscible or immiscible with each other or with lowermost layer 28 or second layer 36. Similarly, the number of upper layers may also be further increased beyond three by extension of the number of die slots (not shown explicitly in FIG. 1).

The multi-slide hopper 10 shown in FIG. 1 includes four separate slide surfaces that are typically used in the manufacture of a product including three distinct layers. During operation, coating composition intended to form the lowermost layer is continuously pumped by a suitable metering pump 26 at an appropriate rate into a cavity 74 from which it passes through a narrow vertical slot 24 out onto downwardly inclined slide surface 54 down which it flows by gravity. In a similar manner, other coating compositions intended to form the layers above the lowermost layer are continuously pumped into cavities 76, 78, and 80 and passed through narrow vertical slots 32, 40, and 48, respectively, onto slide surfaces 58, 60, and 62 respectively, down which they flow by gravity. The layers of coating composition flowing down slide surfaces 54, 58, 60 and 62 flow into coating bead 72 and as moving web 70, passing around backing roll 66, moves across and in contact with coating bead 72 it picks up the four layers of coating composition. As described above, the viscosity and thickness of the lowermost layer, the layer 28 in contact with slide surface 54, and of the layer immediately above it, the layer 36 in contact with slide surface 58, can be so selected that interlayer mixing takes place between these two layers but vortical action of the coating bead 72 is confined to these two layers so that no interlayer mixing occurs with the layers above.

The present invention is suitable for application of multilayer coatings to a variety of substrates such as polyethylene terephthalate (PET), cellulose acetate, polycarbonate, polystyrene, and other polymeric films. Additional substrates may include paper, laminates of paper and polymeric films, glass, cloth, aluminum and other metal supports. In some cases, substrates may be pretreated with subbing layers or electrical discharge devices. Substrates may also be pretreated with functional layers containing various binders and addenda. Examples of multilayer coatings include those coatings made from one or more carrier liquid layers including at least one patterned functional material in one or more of the carrier liquid layers. Examples of functional materials include conductive inks, resistive inks, dyes, pigmented materials or liquids, fluorescent materials, phosphorescent materials, quantum dots, thermochromic materials, magnetic materials, or other materials suitable for use in sensing applications. Carrier liquids suitable for use without a permanent substrate include, for example, cellulose acetates, sol-gels, or polyvinylacetates.

Figure 2:
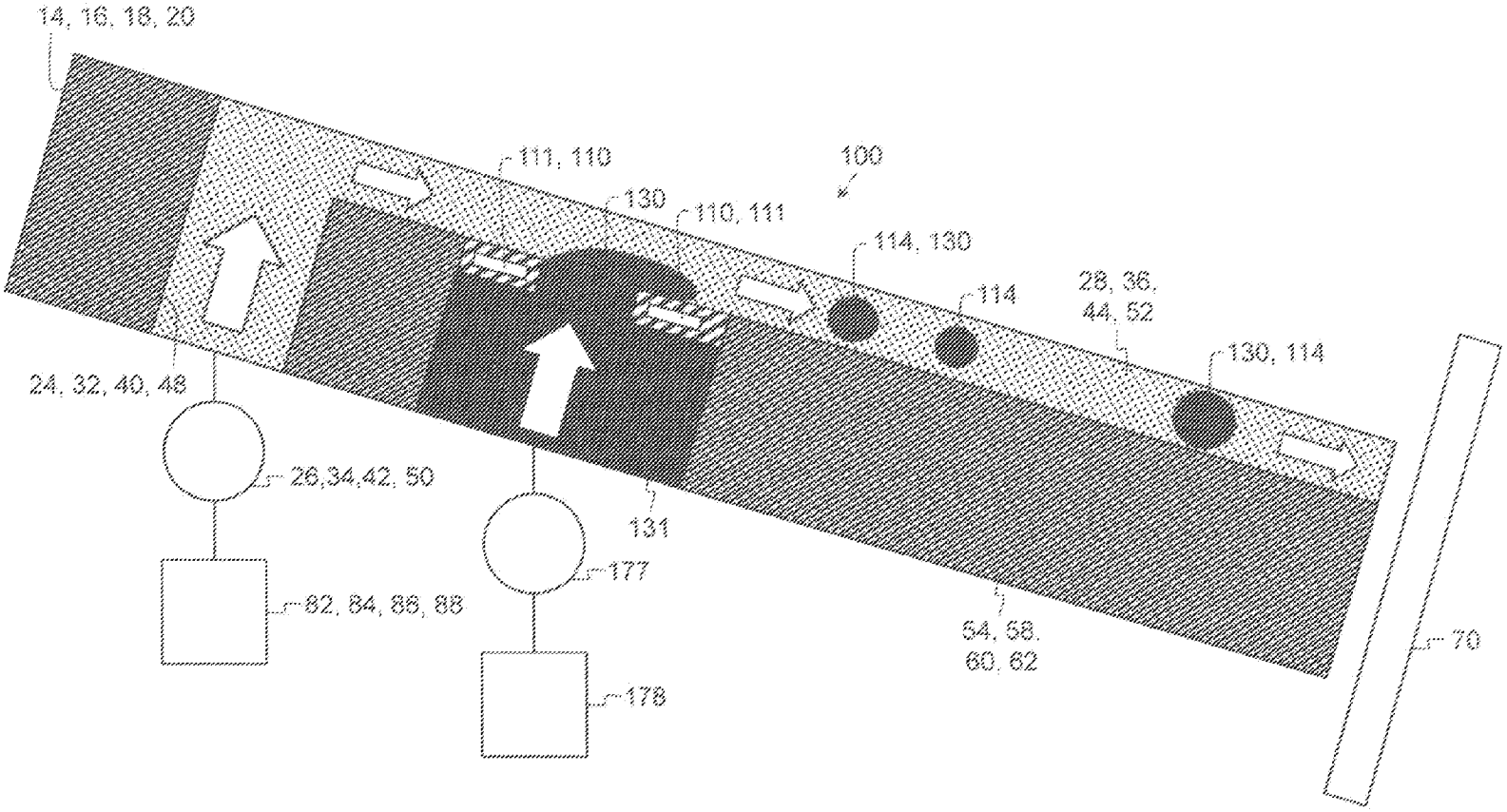
FIG. 2 is a schematic cross sectional side view of a liquid dispenser array, showing drop formation of a second liquid in a first liquid, made in accordance with the present invention.
Figure 3:
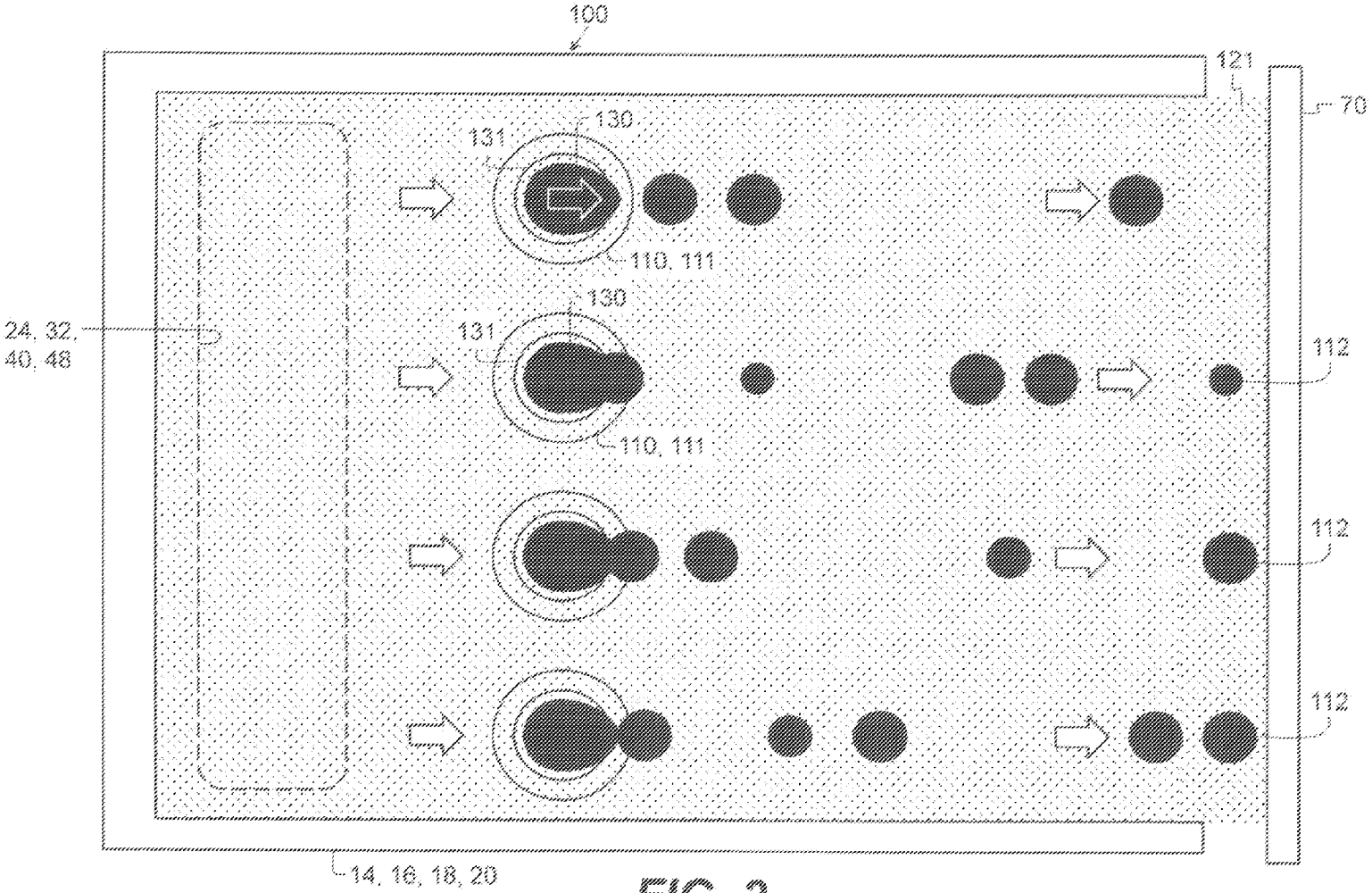
FIG. 3 is a schematic top view of the liquid dispenser array shown in FIG. 2.

Referring to FIGS. 2 and 3, enlarged views of a portion of second section 14 (or third section 16, or fourth section 18, or back plate 20) of liquid dispensing system 10 are shown. FIG. 2 is a schematic cross sectional side view of a liquid dispenser array 100 showing drop formation of second liquid in first liquid and FIG. 3 is a schematic top view of the liquid dispenser array 100 shown in FIG. 2. Liquid dispenser array 100, also referred to as a digital drop generator or a digital drop contact patterning device, provides for the controlled flow of a first liquid, for example, carrier liquid layer 28, and a second liquid, for example, a functional liquid 130. Actuation of a drop formation device 110 results in the controllable formation of functional liquid drops 114 of the second or functional liquid which are carried along inclined slide surface 54 by the movement of the first or carrier liquid 28 toward coating bead 72 and, ultimately, web 70.

Referring to FIG. 2, as described above, regulated pressure source 26 typically provides a positive pressure that is, typically, above atmospheric pressure to pressurize carrier liquid 28 to cause the carrier liquid to flow along inclined slot surface 54 by way of a liquid supply channel, for example, slot 24.

In addition, liquid dispenser array 100, associated with second section 14, (or third section 16, or fourth section 18, or back plate 20) includes a second liquid supply channel 131. Slide surface 54 is in fluid communication with a second liquid source or supply 178 through second liquid supply channel 131. The second liquid supply 178 provides a functional liquid 130 (first liquid) to slide surface 54.

During operation, the functional liquid is periodically pressurized, typically, above atmospheric pressure, by a second regulated pressure source 177, for example, a pump, to form a bulge of the second liquid in liquid dispensing channel 131. Drop formation device 110, associated with the interface of second liquid supply channel 131 and inclined slide surface 54, is actuated to cause a drop 114 of functional liquid 130 to form in the carrier liquid 28 that is flowing along inclined surface 54. Drop formation device 110 includes one or more drop forming transducers which can be controlled digitally in response in input print data. Typically, liquid dispenser array 100 includes of an array of drop formation devices 110.

Focusing now on the drop formation device 110, the pressure on the carrier liquid inlet and functional liquid inlet are adjusted to create a meniscus of a radius of curvature r that balances the pressure P1 at the carrier liquid side of the meniscus and pressure P2 at the functional liquid side of the meniscus with an interfacial surface tension (γ) between the two phases as $$P2 - P1 = \frac{2\gamma}{r}.$$

By adjusting P1, P2 or γ, it is possible to disturb the force balance at the meniscus and change the radius of curvature. This can be achieved with a fluidic transducer 111. When the functional liquid protrudes sufficiently in the carrier liquid flow, the shear forces are sufficient to overcome the surface tension forces to break a functional liquid drop from the nozzle which then flows in the carrier liquid. Thus, by controlling the fluidic transducer 111, one can digitally generate drops 114 of functional liquid 130 on-demand based on input data. Choices for transducers are wide ranging and include those which control interfacial surface tension, liquid viscosities, liquid pressures or flow rates, local shear rate, phase change in carrier liquid (bubble), or geometry modulation. As shown in FIGS. 2 and 3, drop formation device 110 is used to control not only the pattern of the functional liquid drops but also the size of the drops. In the present invention, drop size can be controlled during a drop dispensing operation by changing the stimulation signal provided to the drop formation device 110 by a controller (not shown). For example, the magnitude or the duration of the stimulation signal can be varied in order to change or control the drop size of the functional liquid.

A model of continuous dripping mode drop formation of functional liquid in a cross shear flow of carrier liquid has been described in Universal Dripping and Jetting in a Transverse Shear Flow, Robert F. Meyer and John C. Crocker, Phys. Rev. Lett. 102, 194501 (2009), (hereinafter "Meyer and Crocker"). The model equates the drag force on the liquid meniscus of the functional liquid caused by the flow of the carrier liquid to the surface tension force between interfaces of two liquids that opposes formation. As the shape of the meniscus determines the drag force, the size of the functional liquid channel (orifice) $D_0$, the pressures P1 and P2 or a steady carrier liquid and functional liquid flow rates Q1 and Q2 are important in determining the drop formation.

The frequency of drop formation depends on the flow rate Q1. The viscosity of the functional liquid is important in determining if a functional liquid drop is created or it flows in the form of a sheet. Meyer and Crocker also show that the size of the functional liquid drop is determined by the size of the functional liquid channel $D_0$. This is because the walls in the liquid dispense chamber are sufficiently away from the liquid meniscus and do not affect the fluid dynamics of drop formation.

Once the functional liquid drops 114 are formed and transported by the carrier liquid 28 along inclined slide surface 54, the liquid drops 114 and carrier liquid 28 are transferred to receiver 70. Receiver 70 is typically a moving web. The deposited liquid forms a deposited layer including dispensed functional liquid drops 112 and dispensed carrier liquid 121. In some embodiments, the dispensed carrier liquid 121 can form part of the pattern that is deposited on the receiver along with the functional liquid. When this occurs, the dispensed carrier liquid 121 can be dried, or have moisture or other solvents removed, along with the dispensed functional liquid drops 112. Typically, the functional liquid itself is dried or fixed using other conventional devices or techniques such as, for example, devices or techniques that include radiation or heat cross-linking.

Referring to FIG. 2, the lateral arrangement of the carrier liquid inlets 24, the functional liquid inlets 131, and the drop formation devices 110 is shown. The time controlled formation of functional liquid drops and the motion of the carrier liquid results in a two-dimensional pattern of functional liquid drops that is transferred to the receiver 70 resulting in a patterned deposition. Liquid dispenser array 100 includes a plurality of drop formation devices 110. Typically, the plurality of drop formation devices 110 is arranged in an array, for example, a linear array that is perpendicular to the direction of liquid flow through the liquid dispenser array 100. It should be noted that although a linear array of the drop formation devices 110 is shown in FIG. 2, drop formation devices 110 can be arranged to form any arbitrary pattern in the liquid dispense channel 130. For example, drop formation devices 110 can be arranged in a linear array at an angle to the carrier liquid flow along inclined surface 54 to create a high resolution pattern. Alternatively, drop formation devices 110 can be arranged in two or more groups arranged in lines and separated in their location along the direction of carrier liquid flow.

As shown in FIG. 2, liquid dispenser array 100 includes a carrier liquid inlet, for example, an elongated slot 24, which spans the length of the array of drop formation devices 110 and the plurality of functional liquid inlets 131. In this sense, carrier liquid inlet 24 is common to the plurality of functional liquid inlets 31. Alternatively, the relationship of carrier liquid inlets 23 to functional liquid inlets 31 can be one to two, one to three, or one to four depending on the application contemplated. In other example embodiments of the invention, the relationship between carrier liquid inlets 23 and functional liquid inlets 31 can be one to one.

FIGS. 2 and 3 also represent enlarged portions of third section 16, or fourth section 18, or back plate 20 of liquid dispensing system 10.

Accordingly, reference signs corresponding to aspects of these sections are included in FIGS. 2 and 3.

As described above, drop formation is controlled by actuation of the drop formation transducer 111 of the drop formation device 110. Choices for transducers include, for example, those that control interfacial surface tension, liquid viscosity, liquid pressure or flow rate, local shear rate, phase change in carrier liquid (bubble), piezoelectric, or geometry modulation. Actuation of drop formation device 110 results in the controllable formation of functional liquid drops 114 which are carried along by the movement of the carrier liquid 20 along inclined surface 54 toward coating bead 72.

The liquid dispenser or the liquid dispenser array structure is typically formed from semiconductor material (for example, silicon) using known semiconductor fabrication techniques (for example, CMOS circuit fabrication techniques, micro-electro mechanical structure (MEMS) fabrication techniques, or a combination of both). Alternatively, the liquid dispenser or the liquid dispenser array structure can be formed using other conventional materials and fabrication techniques known in the art.

Referring to back to FIG. 2, a liquid dispenser array structure including a plurality of liquid dispensers is shown. The plurality of liquid dispensers are formed, for example, integrally formed through a series of material layering and processing steps, on a common substrate using the fabrication techniques described above to create a monolithic liquid dispenser structure. When compared to other types of liquid dispensers, monolithic liquid dispenser configurations help to improve the alignment of each outlet opening relative to other outlet openings which improves drop deposition accuracy. Monolithic liquid dispenser configurations also help to reduce spacing in between adjacent outlet openings which increases the dots per inch (dpi) capability of the device.

In the arrangements shown in FIGS. 1-3, the carrier liquid not only assists in metering and transporting functional liquid drops to the receiver but also prevents a direct contact of functional liquid with surrounding air. This feature is very useful in improving reliability of functional liquid drop dispenser by preventing drying of functional liquid, for example, ink, which can result in clogging of one or more regions of the device. Similarly, the carrier liquid also prevents a direct contact of the functional liquid drops to walls of the liquid dispensing array. This helps in avoiding adhesion of the functional liquid to one or more regions of the device.

The invention has been described in detail with particular reference to certain preferred embodiments thereof, but it will be understood that variations and modifications can be effected within the scope of the invention.

PARTS LIST

10 multi-slot slide bead coating apparatus/hopper
12 front section
14 second section
16 third section
18 fourth section
20 back plate
22 inlet
24 first metering slot
26 pump
28 carrier layer
30 inlet
32 second metering slot
34 pump
36 layer
28 inlet
40 third metering slot
42 pump
44 layer
46 inlet
48 fourth metering slot
50 pump
52 layer
54 first inclined slide surface
56 coating lip
58 second inclined slide surface
60 third inclined slide surface
62 fourth inclined slide surface
64 back land surface
66 coating backing roller
70 moving web
72 coating bead
74 cavity
76 cavity
78 cavity
80 cavity
82 liquid source or supply
84 liquid source or supply
86 liquid source or supply
88 liquid source or supply
100 liquid dispenser array
110 drop formation devices
111 fluidic transducer
112 dispensed functional liquid drops
114 functional liquid drops
121 dispensed carrier liquid
130 functional liquid
131 plurality of functional liquid inlets
177 pressure source
178 liquid supply The invention is claimed is:

1. A method of dispensing liquid comprising:

providing a downwardly inclined slide surface;

providing a carrier liquid dispensing channel including an outlet opening on the downwardly inclined slide surface;

providing a source of carrier liquid in fluid communication with the carrier liquid dispensing channel;

pressurizing the source of carrier liquid to cause the carrier liquid to flow continuously through the carrier liquid dispensing channel, through the outlet opening of the carrier liquid dispensing channel and down the downwardly inclined slide surface;

providing a liquid dispenser array structure comprising:

a plurality of functional liquid dispensers located on a substrate that is common to the plurality of functional liquid dispensers, each of the plurality of functional liquid dispensers including:

a functional liquid supply channel;

a source of functional liquid; and a drop formation device at an interface of the corresponding functional liquid supply channel and the downwardly inclined slide surface;

providing a functional liquid to the plurality of functional liquid dispensers through the functional liquid supply channels using one of more of the corresponding sources of functional liquid;

selectively actuating one or more of the drop formation devices to form sequences of one or more discrete drops of the functional liquid in the carrier liquid flowing down the downwardly inclined slide surface, the functional liquid being immiscible in the carrier liquid.

2. The method of claim 1, further comprising:

providing a receiver conveyance mechanism, the receiver conveyance mechanism and the downwardly inclined slide surface being positioned relative to each other; and causing a coating including the carrier liquid and the discrete drops of the functional liquid to be applied to a receiver being transported past the downwardly inclined slide surface by the receiver conveyance mechanism.

3. The method of claim 2, further comprising:

removing the coating from the receiver after application of the discrete drops of the functional liquid in the carrier liquid.

4. The method of claim 1, wherein one or more of the drop formation devices is repetitively actuated to form one or more corresponding lines of functional liquid from discrete drops of the functional liquid.

* * * * *